US007959261B2

(12) United States Patent
Anderson et al.

(10) Patent No.: US 7,959,261 B2
(45) Date of Patent: Jun. 14, 2011

(54) MICRO-FLUID EJECTION DEVICES HAVING REDUCED INPUT/OUTPUT ADDRESSABLE HEATERS

(75) Inventors: Frank Edward Anderson, Sadieville, KY (US); Michael John Dixon, Richmond, KY (US); Jeanne Marie Saldanha Singh, Lexington, KY (US); Timothy Lowell Strunk, Georgetown, KY (US); George Nelson Woolcott, Lancaster, KY (US)

(73) Assignee: Lexmark International, Inc., Lexington, KY (US)

( * ) Notice: Subject to any disclaimer, the term of this patent is extended or adjusted under 35 U.S.C. 154(b) by 757 days.

(21) Appl. No.: 11/745,545

(22) Filed: May 8, 2007

(65) Prior Publication Data

US 2008/0278542 A1 Nov. 13, 2008

(51) Int. Cl.
*B41J 2/14* (2006.01)
*B41J 2/16* (2006.01)

(52) U.S. Cl. ..... 347/50; 347/58

(58) Field of Classification Search ..... 347/50, 347/56–59

See application file for complete search history.

(56) References Cited

U.S. PATENT DOCUMENTS

| | | | | |
|---|---|---|---|---|
| 5,103,246 | A * | 4/1992 | Dunn | 347/58 |
| 5,598,189 | A | 1/1997 | Hess et al. | |
| 6,541,316 | B2 | 4/2003 | Toet et al. | |
| 6,582,062 | B1 | 6/2003 | Childers et al. | |
| 6,616,268 | B2 * | 9/2003 | Parish | 347/58 |
| 6,921,156 | B2 | 7/2005 | Childers et al. | |
| 7,090,338 | B2 | 8/2006 | Axtell et al. | |
| 7,186,636 | B2 | 3/2007 | Gleason et al. | |
| 2006/0164451 | A1 | 7/2006 | Pulver et al. | |

OTHER PUBLICATIONS

"High Breakdown Voltage Scholtky Barrier Diode Using p+ Polycrystalline Silicon Diffused Guard Ring," Liou et al., Electronic Letters, Oct. 26, 1995 vol. 31, No. 22.

"Microfluidics Meets MEMS," Proceedings of the IEEE, vol. 91, #6, Jun. 2003.

* cited by examiner

*Primary Examiner* — Juanita D Stephens

(57) ABSTRACT

Micro-fluid ejection devices, methods for making micro-fluid ejection, heads, and micro-fluid ejection heads having N actuators on a first substrate and logic capable of driving the N actuators on a second substrate. The ejection heads also have less than N electrical connections between the first and second substrates.

20 Claims, 11 Drawing Sheets

MICRO-FLUID EJECTION DEVICES HAVING REDUCED INPUT/OUTPUT ADDRESSABLE HEATERS

TECHNICAL FIELD

The disclosure relates to micro-fluid ejection heads and, in a particular exemplary embodiment, to micro-fluid ejection heads having a reduced number of input/output address lines for ejection heaters disposed on a non-semiconductor substrate.

BACKGROUND AND SUMMARY

Micro-fluid ejection devices such as ink jet printers continue to experience wide acceptance as economical replacements for laser printers. Micro-fluid ejection devices also are finding wide application in other fields such as in the medical, chemical, and mechanical fields. As the capabilities of micro-fluid ejection devices are increased to provide higher ejection rates, the ejection beads, which are the primary components of micro-fluid devices, continue to evolve and become more complex and more costly to manufacture.

Conventional micro-fluid ejection heads are designed and constructed with silicon micro-fluid ejection head chips that include both the ejection actuators for ejection of fluids and logic circuits to control the ejection actuators. However, the silicon wafers used to make silicon chips are currently only available in round format because the basic manufacturing process is based on a single seed crystal that is rotated in a high temp crucible to produce a circular bouts that is processed into thin circular wafers for the semiconductor industry.

The circular water stock is very efficient for relatively small micro-fluid ejection head chips relative to the diameter of the wafer. However, such circular wafer stock is inherently inefficient for use in making large rectangular silicon chips such as chips having a dimension of 2.5 centimeters or greater to provide a larger ejection swath dimension. In fact the expected yield of silicon chips having a dimension of greater than 2.5 centimeters from a circular wafer is typically less than about 100 chips from a six inch diameter wafer. Such a low chip yield per wafer makes the cost per chip prohibitively expensive.

In order to provide an ejection swath of greater than 2.5 centimeters, multiple semiconductor substrates may be attached to a fluid reservoir. However, alignment of individual multiple substrates is difficult and time consuming.

Another approach to providing a greater swath dimension is to provide separate substrates for the heaters and logic/driver devices. In that instance, the heater substrates may be made of relatively large, non-semiconductor materials while the logic/driver devices are provided on a semiconductor substrate that is electrically connected to the heater substrate. While this approach overcomes alignment problems associated with multiple substrates, it may require a significantly large number of input/output lines connecting the two substrates. For example, if a non-semiconductor substrate contains 10,000 heaters, 10,000 wiring connections may be required between the logic/driver substrate and the heater substrate in order to address each heater individually.

Accordingly, there is a need for improved structures and methods for making micro-fluid ejection heads, particularly ejection heads suitable for ejection devices having an ejection swath dimension of greater than about 2.5 centimeters.

In one of the disclosed exemplary embodiments, a micro-fluid ejection head is provided that has N actuators on a first substrate and logic capable of driving the N actuators on a second substrate. The first and second substrates are electrically interconnected with less than N electrical connections.

In other exemplary embodiments, each ejection actuator is associated with a diode that may be selected from vertically aligned and laterally aligned diodes. The diodes enable the use of row and column logic devices for activation of actuators with a reduced number of address line connections between the first and second substrates.

An advantage of the exemplary embodiments is that they may provide improved micro-fluid ejection heads of greater dimensions without adversely increasing a number of electrical connections required to activate the actuators. Another advantage of exemplary embodiments is that multiple process steps may be readily combined to provide structures having the reduced number of electrical connections.

BRIEF DESCRIPTION OF THE DRAWINGS

Further advantages of the exemplary embodiments may become apparent by reference to the detailed description of the exemplary embodiments when considered in conjunction with the following drawings illustrating one or more non-limiting aspects of thereof, wherein like reference characters designate like or similar elements throughout the several drawings as follows.

DESCRIPTION OF THE EXEMPLARY EMBODIMENTS

As described in more detail below, embodiments of the disclosure relate to non-conventional substrates for providing micro-fluid ejection heads. Such non-conventional substrates, unlike conventional silicon substrates, may be provided in large format shapes to provide large arrays of fluid ejection actuators on a single substrate. Such large format shapes are particularly suited to providing page wide printers and other large format fluid ejection devices.

Figure 1:
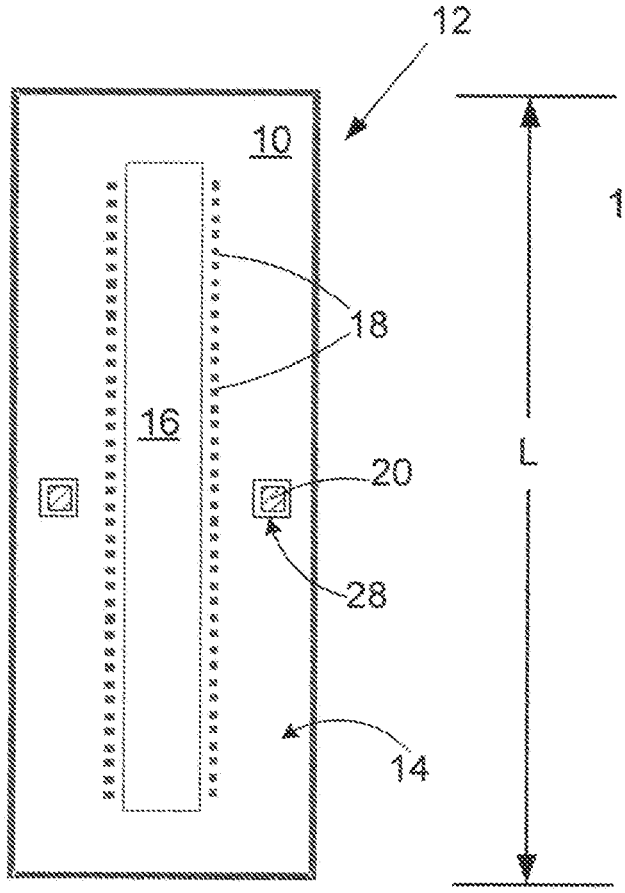
FIG. 1 is a plan view of a substrate containing a logic/device substrate according to an embodiment of the disclosure.
Figure 2:
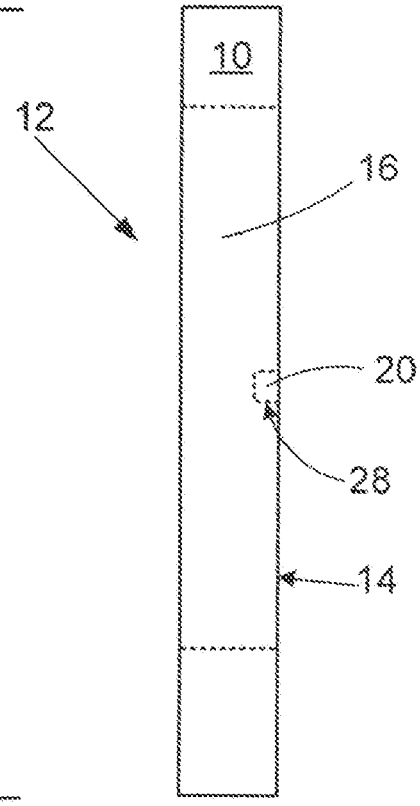
FIG. 2 is a cross-sectional view of the substrate and logic/device substrate of FIG. 1.

According to the disclosure, a substrate 10 (FIGS. 1 and 2) of a micro-fluid ejection head 12 may be provided by materials such as glass, ceramic, metal, plastic, and combinations thereof. A particularly suitable material is a east, roll compacted, dry pressed, or machined non-monocrystalline ceramic material. Such material may be provided with a length dimension L of greater than about 2.5 centimeters and typically have electrically insulating and/or thermal conducting properties suitable for use as the substrate 10. The substrate 10 may be cast, machined, or molded from the substrate material.

In order to provide a surface finish suitable for depositing fluid ejection devices and thin film conductive layers on the device surface 14 of the substrate 10, the device surface 14 of the substrate 10 may be polished to a fine finish and, if desired, coated with a planarizing layer. Polishing alone may be sufficient to provide a surface roughness of less than about 7.5 nanometers, which is generally a sufficiently smooth surface. If not, a layer of glass (for example boro-phosphosilicate glass, BPSG) may be applied as by spinning or by chemical vapor depositing (CVD) onto the device surface 14 of the substrate 10. The techniques for applying the planarizing layer are well known in the semiconductor industry for coating silicon devices, but are not commonly used for coating non-conventional substrates such as substrate 10. There is a greater requirement for smoothness and planarity of the device surface 14 because of die deposition of fluid ejection devices 18 on the device surface 14 adjacent to a fluid supply slot 16 formed in the substrate.

After planarization of the device surface 14 of the substrate 10, a thermal conductive layer may be deposited in a fluid ejection actuator area of the substrate 10 adjacent to the slot 16 and the fluid ejection actuators 18 and conductors therefor, for example, a thin film resistor layer and an anode and a cathode conductor layer, may be deposited adjacent to the thermal conductive layer. The thin film resistor layer and conductor layer may be patterned and etched using well known semiconductor fabrication techniques to provide a plurality of the fluid ejection actuators 18 on the device surface 14 of the substrate. Suitable semiconductor fabrication techniques include, but are not limited to, micro-fluid jet ejection of conductive inks, sputtering, chemical vapor deposition, and the like.

Figure 3:
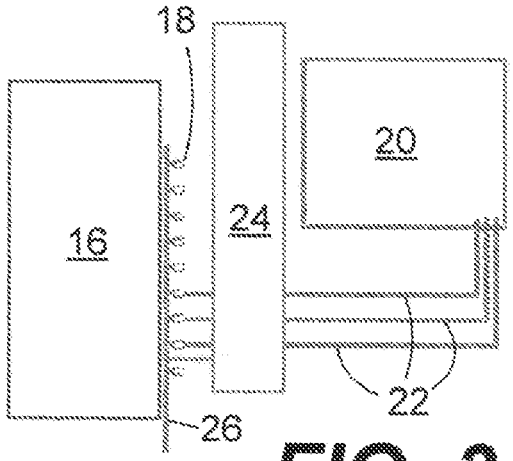
FIG. 3 is an enlarged plan view of a portion of the substrate of FIG. 1 showing connections between actuators on the substrate and logic/driver devices on the logic/device substrate.
Figure 4:
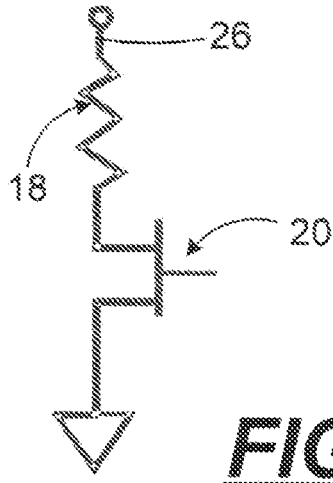
FIG. 4 is a schematic drawing of an actuator and driver circuit therefore.

In order to activate the ejection actuators 18 disposed on the non-semiconductor substrate 10, drivers and/or logic devices 20 are electrically connected to the actuators 18. FIG. 3 illustrates a driver and/or logic device 20, connected to the actuators 18 through electrical tracing 22. A ground bus 24 is also connected to a low side 26 of the actuators 18 to complete the circuit. A schematic drawing of such an electrical circuit is illustrated in FIG. 4. The driver and/or logic device 20 may be attached in a chip pocket 28 of the substrate 10 or may provided on a separate substrate remote from the substrate 10. In any event, for N number of actuators 18, N number of electrical tracing lines 22 are required to activate the actuators 18. For example, if the substrate contains 10,000 actuators, 10,000 electrical tracing lines 22 are required.

According to an exemplary embodiment of the disclosure, a diode may be provided in series with each actuator 18 so as to drastically reduce the number of wiring connections that are required between the actuators 18 and the driver and/or logic devices 20. For example, heater actuators 18 may be arranged in rows and columns with the heaters 18 in each row sharing a common low side ground switch (PET) and heater/diode pairs in each column sharing a common high side Vcc rail switch (PET). In this way the number of wiring connections required for individual heater 18 addressability may be reduced from N (e.g., 10,000) to $2N^{1/2}$ (e.g. 200).

Figure 5:
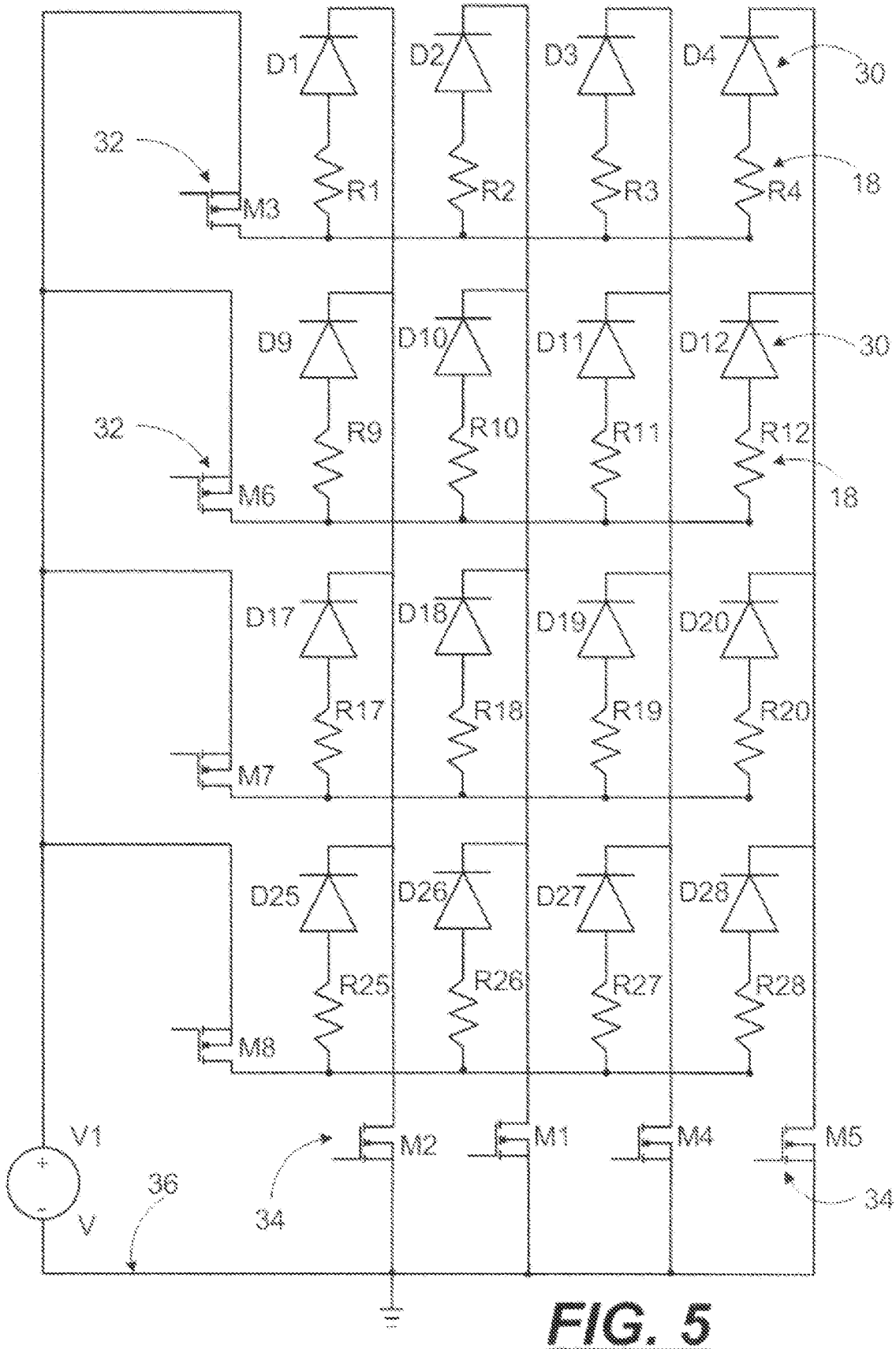
FIG. 5 is a schematic drawing of an actuator and driver circuit matrix with reduced address hues according to an embodiment of the disclosure.

The foregoing heater/diode pairs 18/30 in rows and columns are illustrated in the wiring schematic in FIG. 5 for a four by four array of heaters 18, each with a diode 30 in series. Each row of actuators 18 is controlled by a single row transistor 32 and each column of actuators 18 is controlled by a single column transistor 34. Activation of actuator R27, for example, requires activation row transistor M8 and column transistor M4. Without the diodes 30, each of the sixteen heaters 18 would require one input, i.e., N inputs wherein $2N^{1/2}$ is the number of address lines. With diodes 30 in place, the heaters 18 may be addressed by selecting the appropriate row and column switches 32 and 34 with a total of eight ($2N^{1/2}$) I/O connections (4 rows+4 columns).

Of course if the diodes 30 are disposed on a remotely separate substrate from the substrate 10 containing the actuators 18, a wiring problem may still exist. For example, since each actuator 18 is uniquely connected in series with one diode 30 in the wiring scheme illustrated in FIG. 5, a diode chip or discrete diodes 30 would need to be connected to the substrate 10 on both the high side and low side of each diode 30 thereby requiring 2N, or 20,000 connections.

In order to solve the aforementioned wiring connection issues, the thin film diode 30 may be created on the substrate 10 in series with each actuator 18. However, diode fabrication requires a p-n semiconductor junction or a metal-semiconductor interface. Accordingly, a semiconductor material may need to be deposited on the non-semiconductor substrate 10 to provide suitable diode functionality.

In addition to the need for a semiconductor material, the diode should be capable of switching rapidly so as to avoid degrading a pulse signal experienced by the actuator 18 because fire pulses are on the order of 1 microsecond (μsec) duration. For a one μsec fire pulse, a diode's switching time should not exceed 100 nanoseconds (ns). A diode's switching speed is affected both by the charge carrier mobility in the semiconductor material and for a p-n junction diode by charge carrier recombination times in the depletion region when the voltage polarity is switched. Mobilities are much higher for single crystalline semiconductor materials than for polycrystalline or amorphous forms of the same materials. For example, single crystal silicon has an electron mobility of about 1400 $cm^2$/V-s, amorphous silicon has a mobility of less than 1 $cm^2$/V-s, and polycrystalline silicon mobilities may vary between 1 and 400+ cm/V-s depending on the degree of crystallinity, grain size, grain boundary charge trapping sites, etc.

In order to illustrate the importance of charge carrier mobility for a diode consider the following example in Table 1. A diode having a 0.2 μm diode channel length with a 1 V drop may require about 4 ns for an electron to traverse the channel length distance in single crystal silicon with mobility on the order of 1000 cm/V-s. The same channel length would take more than 4000 ns to traverse in amorphous silicon with a mobility of 1 cm/V-s and about. 40 ns to traverse in polysilicon with a mobility of 100 cm/V-s. Mobilities of less than about 100 cm/V-s are insufficient to guarantee switching speeds of less than 100 ns for this geometry.

TABLE 1

| Semiconductor Material | Mobility ($cm^2$/Vs) | Drift Velocity (cm/sec) | Time to traverse gate (ns) |
|---|---|---|---|
| single crystal silicon | 1000 | 5000 | 4 |
| polysilicon | 100 | 500 | 40 |
| amorphous silicon | 1 | 5 | 4000 |

As described above, as-deposited polysilicon has fairly small grain sizes and typically does not have the greater than 100 cm/V-s mobility required for switching speeds of less than 100 ns. Historically, silicon has been annealed, at a high temperature in excess of 1000° C. to achieve higher mobilities. Such harsh processing drastically constrains the range of substrate choices available and is expensive and/or time consuming.

However, laser recrystallization may he used to achieve higher mobilities in polysilicon without the harsh processing of high temperature annealing. Laser recrystallization of polysilicon provides what is referred to as "low temperature polysilicon" (LTPS) because heating is locally focused in a thin silicon layer of the polysilicon. Excimer laser (ELA) recrystallization applies focused energy pulses that melt silicon in a thin layer near a top surface of the polysilicon. Upon cooling, the molten silicon resolidifies to polysilicon with large grain sizes and fairly high mobilities (80+ cm/V-s). Layers or substrates underlying the molten silicon do not experience high temperatures. There are a number of different variations that fall under the category of LTPS. Among these are:

(1) Excimer Laser Annealing (ELA): This process uses a 308 nm excimer laser with optics to spread a beam in a line (465 mm long by 0.4 mm wide). The line is scanned across the polysilicon substrate such that each location sees 10-20 pulsed irradiations. Crystal growth is in vertical direction starting at an interface between molten and unmolten silicon. Crystallization may be conducted at a rate of about 28 $cm^2$/sec. Resulting crystals are typically 0.3×0.3 $\mu m^2$ and mobilities may range from about 100 to about 150 $cm^2$/Vs.

(2) Two shot Sequential Lateral Solidification (SLS): Grains are grown laterally from solid silicon into a molten zone and are larger/more uniform in size. A laser is scanned across the polysilicon substrate linearly and projected using masks to create alternating on/off periodic fines. A first scan produces lines of polysilicon separated by lines of amorphous silicon. A second scan is offset by half a line pitch such that there is some line overlap. The process produces a continuous laterally oriented polycrystalline structure. Compared to ELA, SLS is capable of up to two times increase in crystallization throughput. SLS has a wider process window on laser fluence and no limit on substrate size.

(3) Solid Phase Crystallization (SPC): The SPC process crystallizes a-Si to p-Si through furnace annealing at temperatures ranging from about 450° to about 600° C. over a period of 12-40 hours.

(4) Continuous Grain Silicon (CGS): CGS combines metal-induced crystallization (a kind of solid phase crystallization, SPC) and ELA. The CGS process is capable of achieving higher mobilities (about 300 $cm^2$/Vs) than that produced by conventional line-beam ELA. The ELA process may be used to improve the crystallinity of polysilicon after a metal-induced crystallization process. A potential issue with CGS is metal contamination in the polysilicon, which may result in a high leakage current of a polysilicon TFT/diode.

(5) Selectively enlarging laser crystallization (SELAX): SELAX technology is a process developed by Hitachi Displays, Ltd. of Tokyo, Japan using a solid state laser to achieve 150 $cm^2$/V-s mobilities. According to the process, by controlling a pulse width of a solid-state laser and emitting the beam on the polysilicon, the silicon's thin film is optimally melted and congealed to form "pseudo-mono crystal silicon". The SELAX technology produces a 20 times larger crystal grain size, and forms a flat surface polysilicon film.

With respect to devices made by polysilicon recrystallization techniques, U.S. Pat. No. 6,541,316 to Toet et al. describes a method of integrating laser crystallized polysilicon P-N junction and Schottky diodes in an n×n array of MRAM cells in a memory device. Such Schottky diodes may perform a suitable addressing I/O reduction function similar to that required for an array of thin film heaters as described above with reference to FIG. 5.

Schottky diodes typically have fast switching speeds. A Schottky interface is a metal-semiconductor interface. The difference between the work function of the metal and the Fermi energy in the semiconductor results in a potential barrier or impediment to current flow called the "Schottky Barrier". Schottky diodes formed from n-type semiconductor-metal interfaces are fast switching relative to P-N junction diodes because such diodes are majority carrier devices (i.e., conduction is by electrons e− only and not holes). Schottky diodes typically do not exhibit the relatively slow hole/electron recombination that takes place in the depletion region in P-N junction diodes when voltage polarity is reversed.

As illustrated by the matrix of actuators 18 and diodes 30 in FIG. 5, several actuators share a ground bus 36. The ground bus 36 may need to be sized to accommodate the current from multiple actuators 18 being potentially fired simultaneously at about 30 mA per actuator 18. For the situation where n actuators 18 are fired simultaneously, the ground bus 36 must accommodate n×30 mA current (I) without dissipating too much power. For fluid jet ejection devices such as printers, it is not uncommon for more than twenty-five actuators 18 to be fired simultaneously in order to achieve high page throughputs. The power (P) dissipated by a ground bus metallization is dictated by the number of "squares" of the metal (Length/width), the sheet resistivity (ρ) of the metallization (ohms/square), and the current through that ground bus 36 (as described above) according to the following equation:

$$P=I^2R=I^2\times(\text{number of squares})\times\rho$$

A thin film metallization layer having a thickness of less than about 2 μm and a width of less than about 100 μm may be incapable of carrying the kind of current that is expected from the multiple fire event described above without unacceptable power dissipation and associated substrate heating. However, larger ground bus widths may require a wider substrate for support of the ground bus 36. For example, the matrix addressing scheme of FIG. 5 may require a thick film ground bus metallization of greater than about 6 μm in thickness with thin film diodes/actuators 30/18 and associated wiring.

One exemplary embodiment of the disclosure provides a thin film diode on a non-semiconductor substrate such as ceramic or glass having a length dimension of greater than 2.5 centimeters. The embodiment uses LTPS technology to provide a high mobility polysilicon layer on the substrate 10 for the thin film diodes 30. The process integrates the thin film processing steps required for actuator fabrication with those required for diode fabrication such that several steps are shared and the diodes may be created with a minimal number of incremental processing/mask/photo processing steps. Exemplary embodiments are provided for vertical and lateral diode construction and for Schottky as well as P-N junction diodes in FIGS. 6 and 7. Methods for providing the thick film metallization for the ground bus 36 wiring are also exemplified below in FIG. 9 for both ceramic and glass substrates 10.

In a first exemplary process, an integrated actuator and vertically oriented Schottky or P-N junction diode process is described. The thin film processing steps for a vertically oriented Schottky diode are illustrated in FIG. 6A-6J. Some of the process steps are common to both actuator and diode fabrication and may he combined. Other steps are for actuator fabrication alone or for diode fabrication alone.

The purpose of the planarization/thermal barrier layer is two-fold. First, the presence of defects larger than about 75 angstroms in a heater surface can provide nucleation points for heterogeneous nucleation. Thermal micro-fluid ejection processes rely on homogeneous nucleation at the superheat limit of the fluid to provide the explosive energy required for jetting events to take place.

The second purpose of the planarization/thermal barrier layer is to provide a thermal barrier such that the energy from the electrical heating pulse is directed into the fluid drop and is not dissipated into the substrate. On a ceramic substrate, the thermal barrier layer is optimally about 1 to 2 μm thick. Thicker barrier layers inhibit thermal dissipation after the firing event and can limit maximum firing frequencies to those achievable on a glass substrate.

Figure 6A:
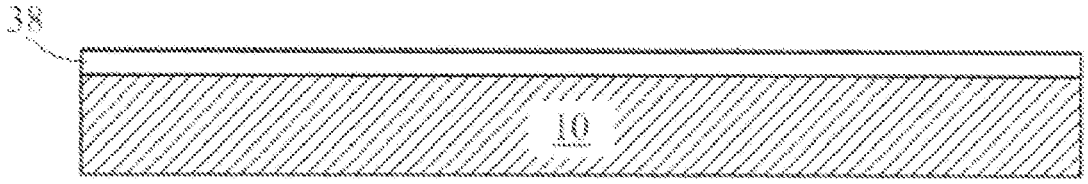
FIGS. 6A-6J is a process flow scheme for making a vertical diode and ejection actuator according to a first embodiment of the disclosure.

For a glass substrate, the steps described in FIG. 6A may not be required since the substrate is suitably planar and smooth already. Glass substrates do not require a thermal barrier layer as the whole substrate is already thermally insulative, but they will have lower allowable firing frequencies than more thermally conductive ceramic substrates.

At this point in the process whether using a glass substrate or a glazed ceramic substrate it is typical in the display panel industry to deposit a diffusion barrier layer consisting of CVD $SiO_2$ and $Si_3N_4$. The diffusion barrier layer is typically about 1000 Angstroms thick and prevents diffusion of alkaline species from the glass substrate or planarizing glaze layer into the semiconductor silicon layer which is deposited adjacent to the diffusion barrier layer. Accordingly, a diffusion barrier layer may be required for the same purpose in this process.

Figure 6B:
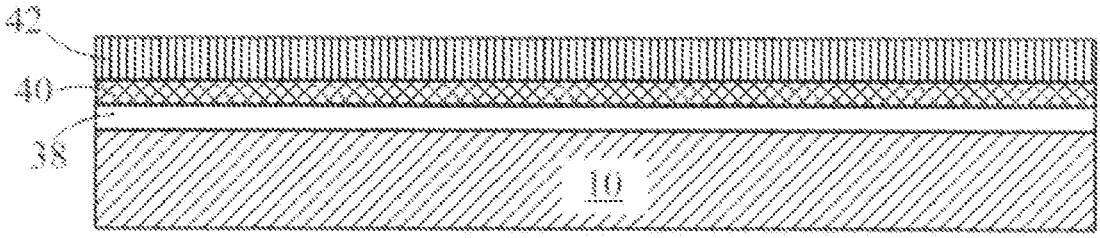

In a second step of the process, illustrated in FIG. 6B, a resistive layer 40 is sputtered adjacent to the substrate 10 and/or planarization layer 38. DC magnetron sputtering is typically used for this step. The resistive layer may be made from a wide variety of resistive materials, including, but not limited to, tantalum, aluminum, TaAl, TaAlN, TaN, $HfB_2$, and $ZrB_2$, SiCrC, TaSiC, or doped polysilicon.

In step three, also illustrated in FIG. 6B, a high temperature first metal layer 42 having diffusion barrier properties and suitable Schottky barrier properties is deposited, as by sputtering, adjacent to the resistive layer 40. Commonly used metals for the first metal layer 42 may be selected from Au, Ag, Al, and Pt. Metals with slightly lower barrier height include W, Ni, and Mo. It may also be important to provide the first metal layer 42 having a high melt temperature along with diffusion barrier properties to inhibit interdiffusion of the metal with the polysilicon layer during recrystallization. Metals which may provide suitable diffusion barrier layers and have relatively high melt temperature include, but are not limited to, W, Ti, Mo, Ta, and Co. It is possible that a metal may be selected to provide both the Schottky barrier function and the diffusion barrier function. For example, W or Mo both form Schottky contacts with n-Si and may also provide suitable diffusion barriers. If a higher Schottky barrier is required, such as that afforded by a Au/n-Si contact, and interdiffusion during an annealing step, described below, proves to be a problem, an alternate approach is to use a high melt temperature barrier metal for the first metal layer 42, reverse the doping profile in the polysilicon, and select a second metal layer such that the Schottky barrier is at a top contact with the n-Si instead of at a bottom contact with the n-Si thereby reversing the polarity of the diode.

Figure 6C:
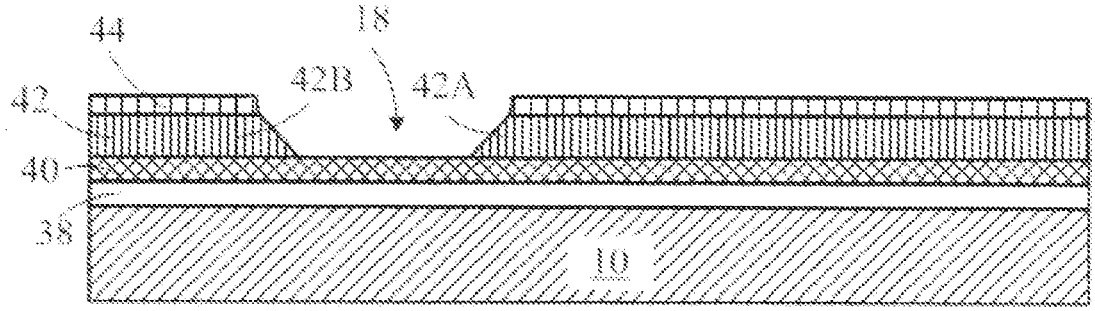
Figure 6D:
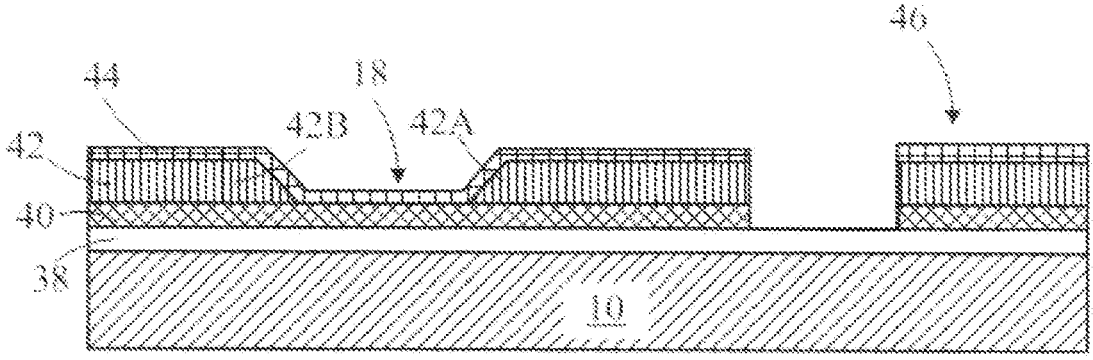

In step four, FIG. 6C, a photoresist layer 44 is applied adjacent to the first metal layer 42 to define and etch through the first metal layer 42 provide the actuator 18. The first metal layer 42 is wet etched to provide sloped conductors 42A and 42B for the actuator 18. In step five, FIG. 6D, a location 46 for a diode is etched through the first metal layer 42 and resistive layer 40. Accordingly, the first metal layer 42 may be used for both the ejection actuator 18 and diode 10. Etching steps illustrated in FIGS. 6C and 6D for the actuator 18 and diode 30 may also be combined into a single step.

Figure 6E:
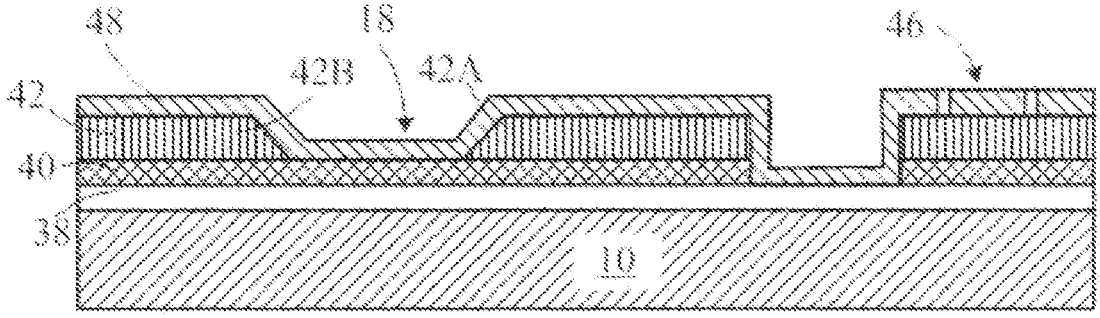

In step six, FIG. 6E, an amorphous silicon layer 48 (typically about 500 Angstroms thick) is deposited on the first metal layer 42, the diode location 46 and the actuator 18 by chemical vapor deposition (CVD) or sputtering. A typical plasma enhanced chemical vapor deposition (PECVD) process uses $SiH_4$ and $H_2$. After deposition and prior to recrystallization it is necessary to perform a dehydrogenation anneal at about 400° C. to remove potentially explosive hydrogen atoms incorporated during deposition. An N type ion implant or deposition, or an N+ (arsenic/phosphorus) implant or deposition is applied for a Schottky diode. A low temperature laser recrystallization process (LTPS) selected from the processes described above is used to convert the amorphous silicon layer 48 to polysilicon with an increased ion mobility and also to drive the N-type implant diffusion into the polysilicon layer to the appropriate depth. If desired, a P+ (boron) photo/implant dopant guard ring is applied around the periphery of the diode location 46 to improve the voltage breakdown of the diode. The P+ dopant guard ring may increase reverse bias breakdown voltage and lowers leakage current by effectively putting a p-n junction diode in parallel with the Schottky diode around the edge of the diode.

Figure 6F:
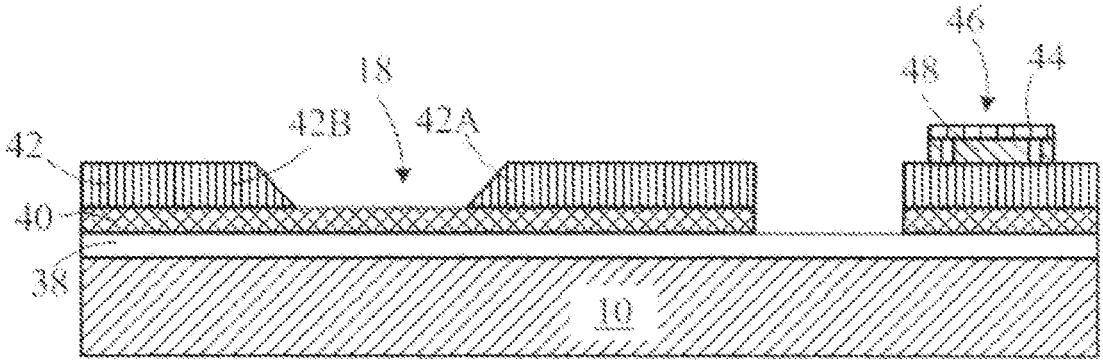

In step seven, illustrated in FIG. 6F, a photoresist layer 44 is deposited on a portion of the polysilicon layer 48 and the polysilicon layer 48 is photoimaged and etched to define boundaries for a diode In location 46. Dielectric material 52 selected from $Si_3N_4$, AlN, SiON, and $Al_2O_3$ is deposited by a sputtering technique as provided. In step eight, FIG. 6G. Multiple materials, such as silicon nitride/silicon carbide, may be used to provide the dielectric material 52. The dielectric material 52 deposition and etch steps may be shared by the actuator 18 and diode 30 so that multiple deposition, and etching for actuator 18 diode 30 may be avoided.

Figure 6G:
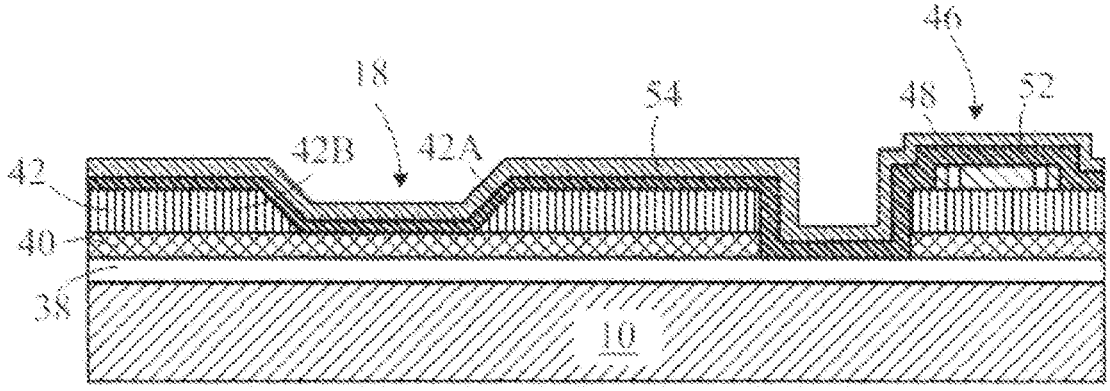
Figure 6H:
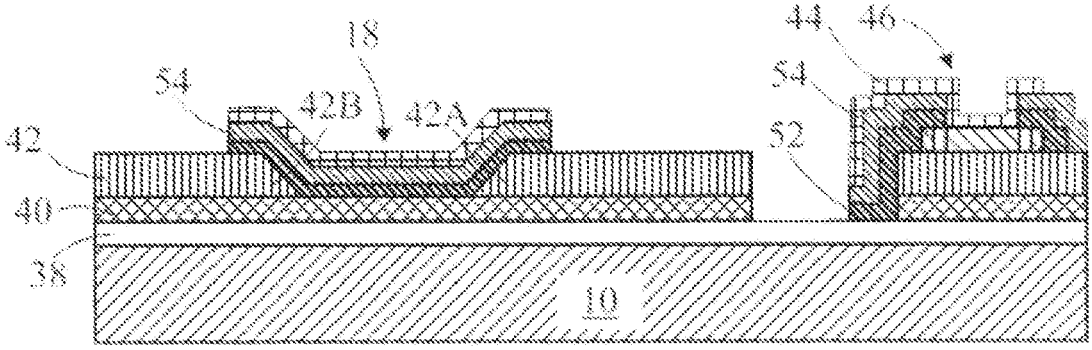

In step nine, a cavitation layer 54 such as sputtered Ta/TaN, may be deposited adjacent to the dielectric material 52 as shown in FIG. 6G. The dielectric material 52 and cavitation layer 54 may then be photoimaged and developed using a photoresist material 44 as shown in FIG. 6H. In the alternative, the cavitation layer 54 may be separately photoimaged and developed over the diode location 46 to prevent electrical short pathways between the diode and adjacent cavitation layer 54 material. Accordingly, it may also be acceptable to leave the cavitation layer 54 in place over the dielectric material 52 as long as no short pathways exist between adjacent diodes through the cavitation layer 54.

Figure 6I:
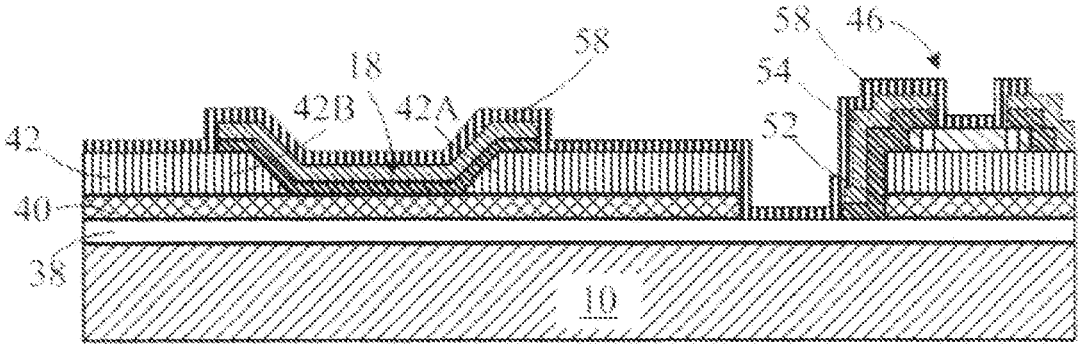
Figure 6J:
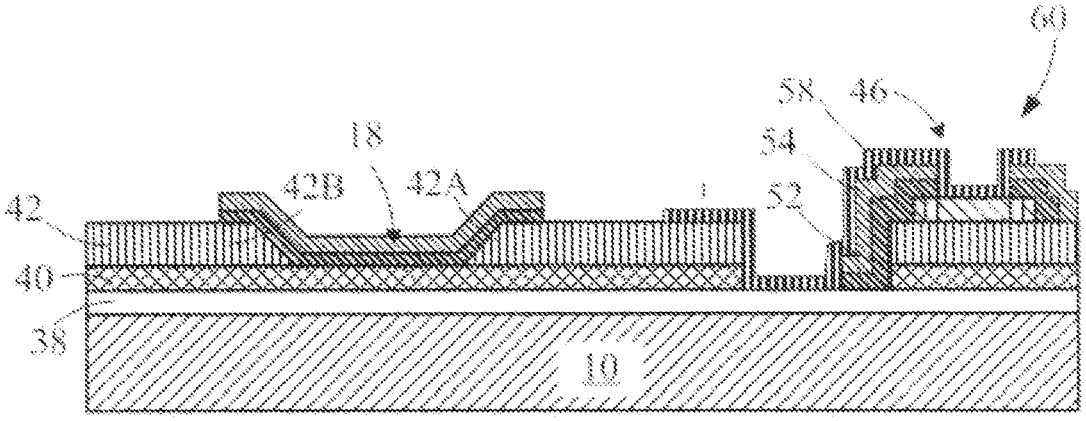

In step ten, illustrated in FIG. 6I, a second metal layer 58 is deposited adjacent to the diode location 46, actuator 18, and planarization layer 38. The second metal layer 58, such as sputtered aluminum, is photoimaged and developed to provide the structure 60 illustrated in FIG. 6J. As described in step three above, the doping profile for the polysilicon may be reversed and the second metal layer 58 may be used as the top contact for the Schottky barrier. Accordingly, the second metal layer 58 may be selected for its Schottky barrier properties in contact with n-Si.

In an alternate embodiment, a vertical diode/actuator process may be applied to a p-n junction diode. In this embodiment, there is no longer a consideration of Schottky barrier potential in the selection of first metal layer 42 and second metal layer 58 (steps three and ten). However, the first metal layer 42 may still be selected for its refractory/diffusion barrier properties. In order to effect a P-N junction process the LTPS process (step six) above is modified by depositing amorphous silicon (CVD or Sputtering) with N or P type ion implant or deposition. The polysilicon has P+ doping (typically boron) for N type silicon or N+ (arsenic/phosphorus) implant or deposition for P type silicon to create a p-n junction within the silicon. A suitable LTPS process such as ELA, SLS or some other suitable LTPS laser recrystallization process is used to recrystallize the silicon and activate/drive the dopant into the silicon. In an alternative process, the doping profile may be reversed to reverse the polarity of the diode.

In a second exemplary process, an integrated actuator 18 and laterally oriented Schottky or P-N Junction diode is provided as illustrated in. FIGS. 7A-7K. In a first step of the process illustrated in FIG. 7A, a thermal barrier/planarization layer 38, typically made of borophosphosilicate glass (BPSG) or silicon-on-glass (SOG), is deposited adjacent to the non-semiconductor substrate 10. BPSG is typically applied with a sub atmospheric pressure in a chemical vapor deposition (CVD) process. The penalization layer (BPSG or SOG) is then thermally reflowed to provide suitable planarization of the substrate 10.

As described above, the purpose of the planarization/thermal barrier layer Is two-fold. First, the presence of detects larger than about 75 angstroms in a heater surface can provide nucleation points for heterogeneous nucleation. Micro-fluid ejection processes rely on homogeneous nucleation at the superheat limit of the fluid to provide the explosive energy required for jetting events to take place.

The second purpose of the planarization/thermal barrier layer is to provide a thermal barrier such that the energy from the electrical heating pulse Is directed into the ink drop and is not dissipated in the substrate. On ceramic substrates, the thermal barrier layer is optimally about 1 to 2 μm thick. Thicker thermal layers inhibit thermal dissipation after the firing event and can limit maximum firing frequencies to those achievable on a glass substrate.

Figure 7A:
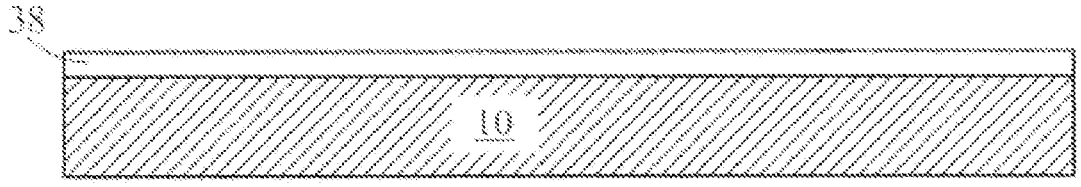
FIGS. 7A-7K is process flow scheme for making a lateral diode and election actuator according to a second embodiment of the disclosure.

For a glass substrate 10, the steps described in FIG. 7A may not be required since the substrate is suitably planar and smooth already. Glass substrates do not require a thermal barrier layer as the whole substrate is already thermally insulative, but they will have lower allowable firing frequencies than more thermally conductive ceramic substrates.

At this point in the process whether using a glass substrate or a glazed ceramic substrate it is typical in the display panel industry to deposit a diffusion barrier layer consisting of CVD $SiO_2$ and $Si_3N_4$. The diffusion barrier layer is typically about 1000 Angstroms thick and prevents diffusion of alkaline species from the glass substrate or planarizing glaze layer into the semiconductor silicon layer which will be deposited on top of if. Accordingly, a diffusion barrier layer may be required for the same purpose in this process.

Figure 7B:
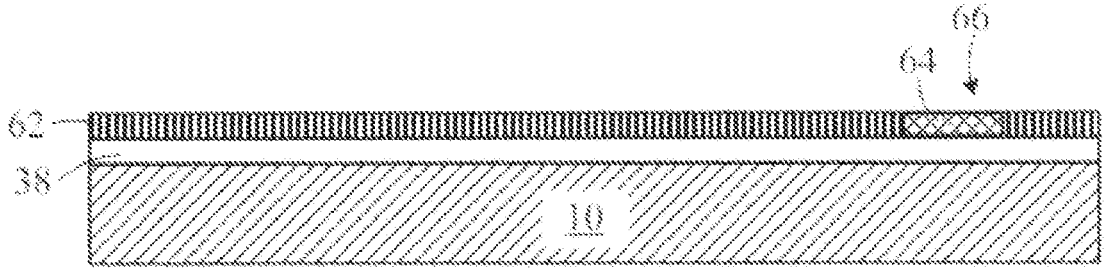

In step two, FIG. 7B, an amorphous silicon layer 62 is deposited by means of CVD or sputtering adjacent to the thermal barrier/planarization layer 38. A typical plasma enhanced chemical vapor deposition (PECVD) process uses $SiH_4$ and $H_2$. After deposition and prior to recrystallization it is necessary to perform a dehydrogenation anneal at ~400° C. to remove potentially explosive hydrogen atoms incorporated during deposition. An N type doping, or N+ doping 64 for a Schottky diode, is implanted or deposited in diode area 66 of the silicon layer 62. A low temperature laser recrystallization process (LTPS) selected from the processes described above is used to increase the ion mobility of the polysilicon layer 62 and to drive the dopant diffusion.

Figure 7C:
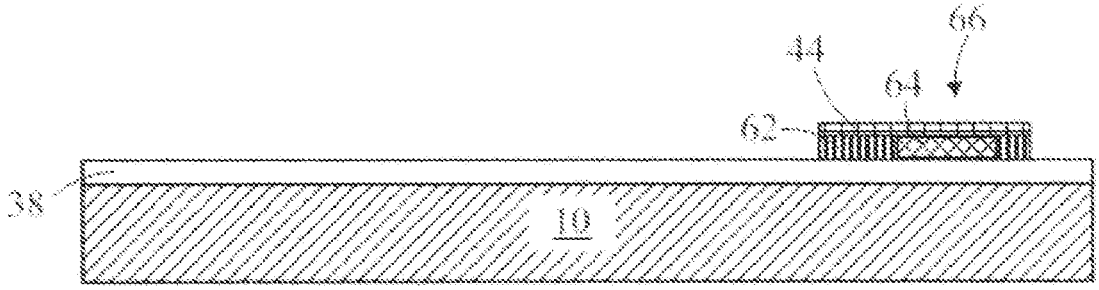

In step three, FIG. 7C, a photoresist layer 44 is deposited adjacent to the polysilicon layer 62 and the polysilicon layer 62 is imaged and developed to provide polysilicon only in the diode area 66.

Figure 7D:
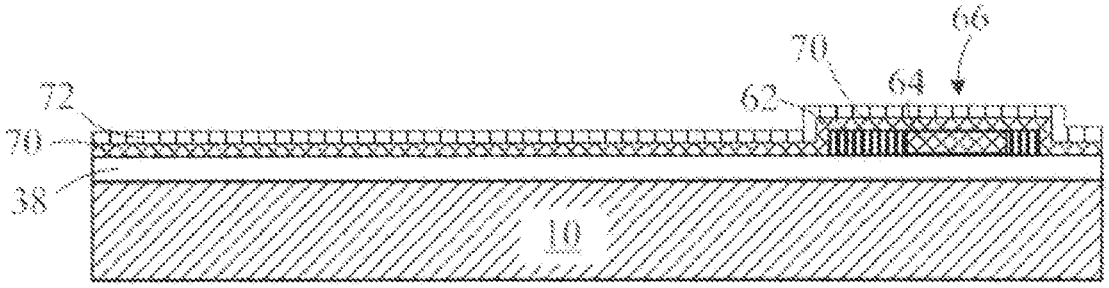

In step four of the process, illustrated in FIG. 7D, a resistive layer 70 is sputtered adjacent to the barrier/planarization layer 38 and remaining polysilicon layer 62. DC magnetron sputtering is typically used for this step. The resistive layer 70 may be made from a wide variety of resistive materials, including, but not limited to, tantalum, aluminum, TaAl, TaAlN, TaN, $HfB_2$, and $ZrB_2$, SiCrC, TaSiC, or doped polysilicon. In the case of doped-polysilicon for the actuator 18 and the diode 30, deposition of a separate resistive layer 70 may not be required.

In step five, also illustrated in FIG. 7D, a high temperature first metal layer 72 having diffusion barrier properties and suitable Schottky barrier properties is deposited, as by sputtering, adjacent to the resistive layer 70. Commonly used metals for the first metal layer 72 may be selected from Au, Ag, Al, and Pt. Metals with slightly lower barrier height include W, Ni, and Mo. It may also be important to provide the first metal layer 72 having a high melt temperature along with diffusion barrier properties to inhibit intermixing the metal with the polysilicon layer during recrystallization. Metals which may provide suitable diffusion barrier layers and have relatively high melt temperature include, but are not limited to, W, Ti, Mo, Ta, and Co. It is possible that a metal may be selected to provide both the Schottky barrier function and the diffusion barrier function. For example, W or Mo both form Schottky contacts with n-Si and may also provide suitable diffusion barriers. If a higher Schottky barrier is required, such as that afforded by a Au/n-Si contact, and interdiffusion during an annealing step, described below, proves to be a problem, an alternate approach is to use a high melt temperature barrier mend for the first metal layer 72, reverse the doping profile in the polysilicon, and select a second metal layer such that the Schottky barrier is at a top contact with the n-Si instead of at a bottom contact with the n-Si thereby reversing the polarity of the diode.

Figure 7E:
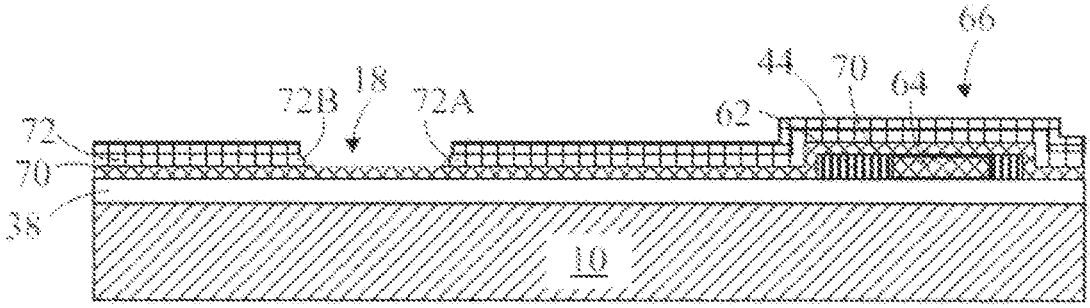
Figure 7F:
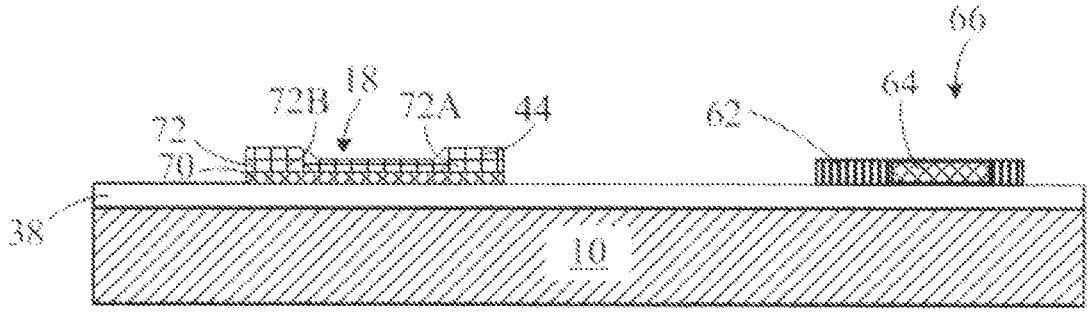

In step six, FIG. 7E, a photoresist layer 44 is applied adjacent to the first metal layer 72 to define and etch through the first metal layer 72 in order to provide the actuator 18 as described above. The first metal layer 72 is wet etched to provide sloped conductors 72A and 72B for the actuator 18 and to remove the first metal layer 72 from the diode area 66 as shown in FIG. 7F.

Figure 7G:
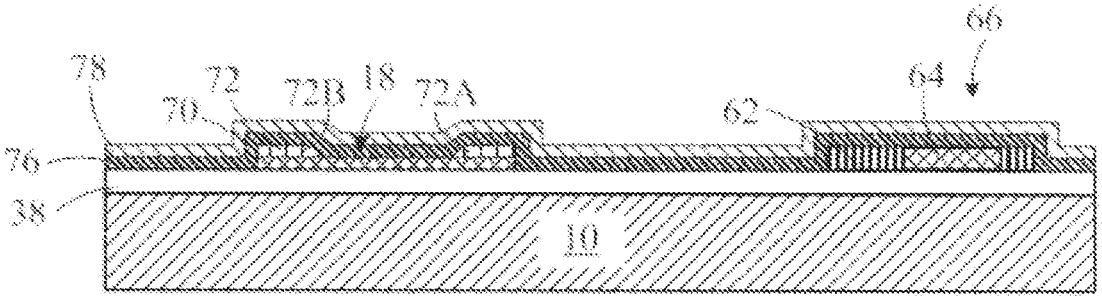

In step seven, illustrated in FIG. 7G, a dielectric material 76 selected from $Si_3N_4$, AlN, SiON, and $Al_2O_3$ is deposited adjacent to the actuator 18, the barrier/planarization layer 38 and in the diode area 66 by a sputtering technique. As described above, multiple materials, such as silicon nitride/silicon carbide, may be used to provide the dielectric material 76.

Figure 7H:
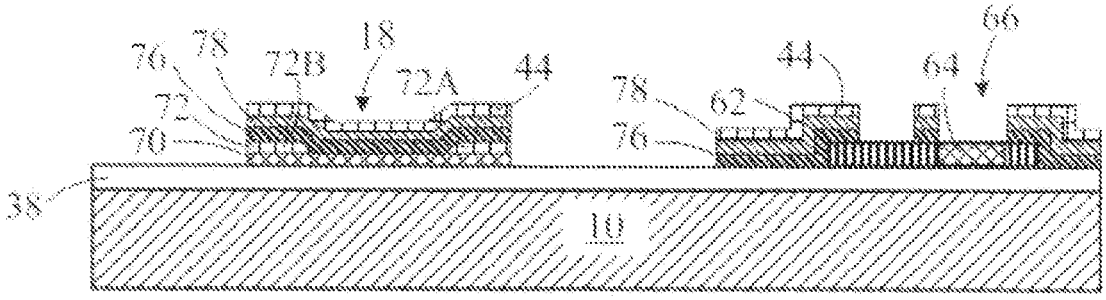
Figure 7I:
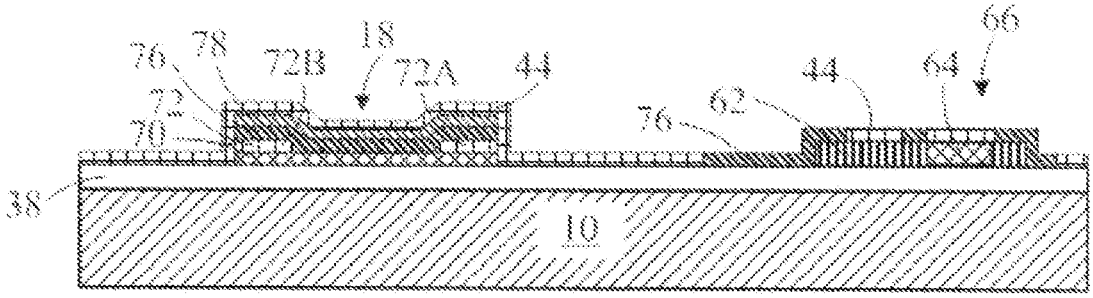

In step eight, a cavitation layer 78 such as sputtered Ta/TaN, may be deposited adjacent to the dielectric material 76. The dielectric material 76 and cavitation layer 78 may then be photoimaged and developed using a photoresist material 80 as shown in FIG. 7H. In the alternative, the cavitation layer 78 may be separately photoimaged and developed over the diode area 66 to prevent electrical short pathways between the diode and adjacent cavitation layer 78 material as illustrated in FIG. 7I. Accordingly, it may also be acceptable to leave the cavitation material 78 in place in the dielectric area 66 as long as no short pathways exist between adjacent diodes through the cavitation layer 78.

Figure 7J:
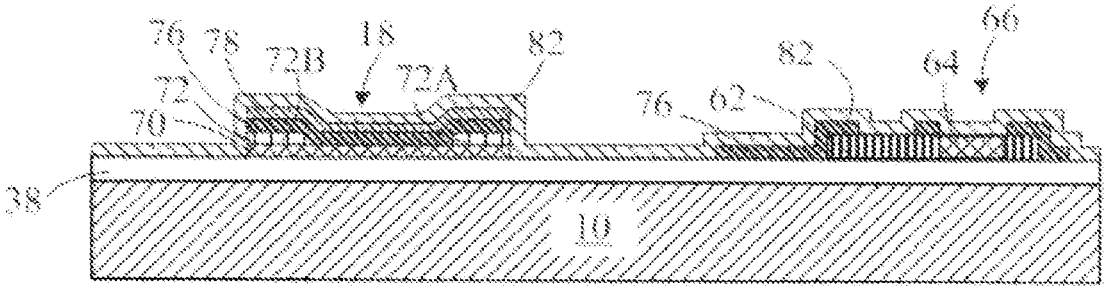
Figure 7K:
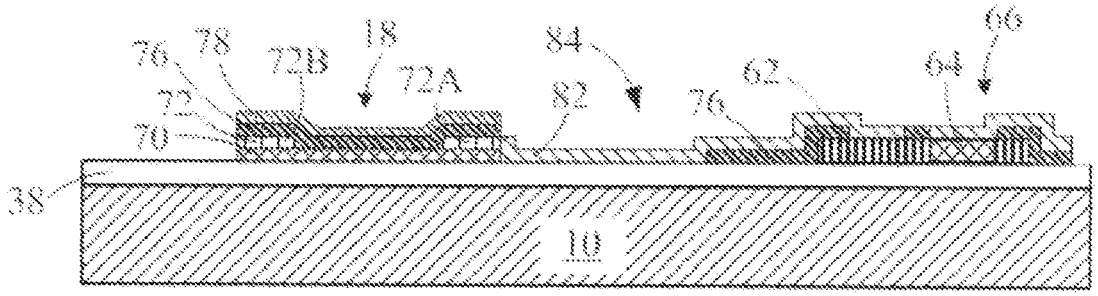

In step nine, as shown in FIG. 7J, a second metal layer 82 is deposited over the diode area 66, actuator 18, and dielectric layer 76. The second metal layer 82 may be selected from Au, Ag, Al, Pt, or it may be selected from metals having a slightly lower barrier height including, but not limited to, W, M, and Mo. The second metal layer is then photoimaged and developed to provide the structure 84 illustrated in FIG. 7K.

In another alternate embodiment, a lateral diode/actuator process may be applied to a p-n junction diode. In this embodiment, there is no longer a consideration of Schottky barrier potential in the selection of first metal layer 72 and second metal layer 82 (steps five and nine). However, the first metal layer 72 may still be selected for its refractory/diffusion barrier properties. In order to effect a P-N junction process the LTPS process (step two) above is modified by depositing amorphous silicon (CVD or Sputtering) with N or P type ion implant or deposition. The polysilicon has a P+ doping (typically boron) for N type silicon or N+ (arsenic/phosphorus) implant or deposition for P type silicon to create a p-n junction within the silicon. A suitable LTPS process such as ELA, SLS or some other suitable LTPS laser recrystallization process is used to recrystallize the silicon and activate/drive the dopant into the silicon. In an alternative process, the doping profile may be reversed to reverse the polarity of the diode.

Figures 8A, 8B:
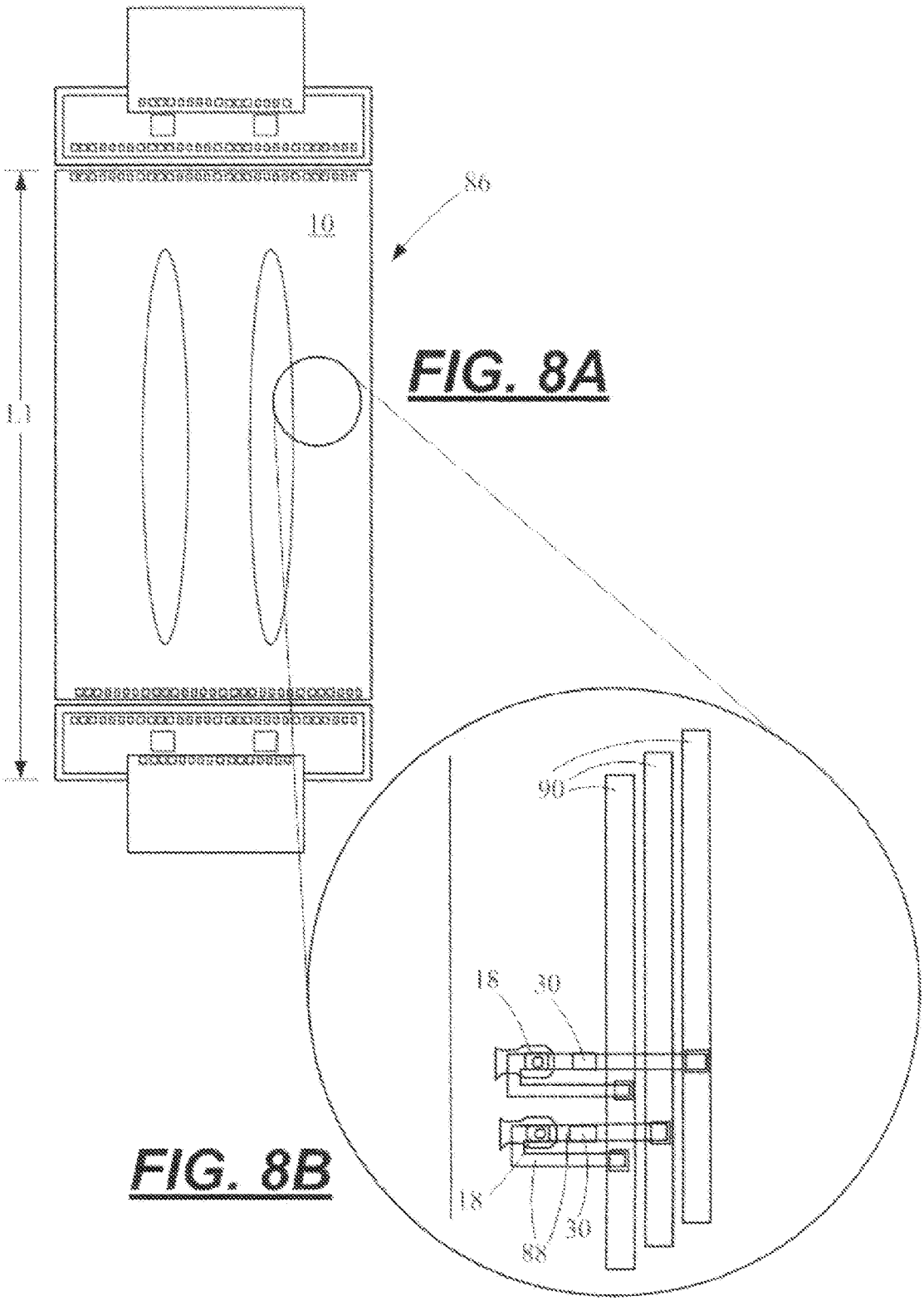
FIG. 8A is a plan view of a substrate according to the disclosure.
FIG. 8B is an enlarged plan view of a portion of the substrate of FIG. 8 showing address and bus metallization lines.

FIG. 8 illustrates a layout of an ejection head 86 including actuators 18, diodes 30, thin film address lines 88 from Vcc, and thick film shared ground bus lines 90 for an integrated thin film actuator/diode made by one of the processes described above. In FIG. 8, the thick film bus lines 90 run parallel to a length L1 of the substrate 10 and are perpendicular to the thin film address lines 88 from each diode/actuator 30/18. Connections between thick bus lines 90 and thin film address lines 88 are made through vias in the dielectric layer 52 or 76. Depending on the substrate material, the thick film bus lines 90 may be provided in different ways.

For example, a variety of techniques may be used to form thick film metallization channels in ceramic or glass substrates prior to depositing metallization for the thin film address lines 88. The channels may be formed in the substrate so that ground bus lines 90 with adequate conductivity to accommodate simultaneous fire situations may be provided as described above. Additionally, techniques may be used to embed metal underneath and adjacent to the actuator 18 location for thermal dissipation reasons. Once the embedded thick film bus lines 90 in place the substrate 10 may be planarized as described above with reference to FIGS. 6A and 7A. The dielectric or BPSG layer 52 or 76 may be applied and holes can be opened in the dielectric layer 52 or 76 using photolithographic techniques in the appropriate locations to make contacts to the thick film metallization bus lines 90. One of the processes described above with reference to FIGS. 6A-6J or FIGS. 7A-7K may be used to provide the actuators, diodes, first and second metal layers providing the address line 88 and ground bus lines 90.

For ceramic substrates obtained from fairly high purity fired wafers, such as wafers having an $Al_2O_3$ content ranging from 96 to 99.6 wt %, or as east tapes in a green state, several methods may be used for embedding the thick film bus lines 90 in the ceramic.

In a first process, microchannels for the thick film bus lines 90 are formed in a ceramic green tape. The base ceramic structure may be made from tape cast layers using available co-firable ceramic material sets, either Low or High temperature co-fired ceramics, based on $Al_2O_3$ or AlN ceramic materials.

Channels for the thick film bus lines 90 may be made in the ceramic substrate in a variety of ways. For a low temperature co-fired ceramic (LTCC) that is a composite of glass and ceramic $Al_2O_3$, a tape layer in the green state may be punched through or CNC milled/drilled before mating and laminating the tape to other green tape layers. Alternatively, hot embossing may be used to form channels in the LTCC material at pressures of about 1000 to about 3000 psi and temperature ranging from 50° C. to about 150° C. for 5-20 minutes. If necessary, the use of sacrificial volume materials (SVM) and other Insert materials can be used to fill in the channels to hold channel dimensions during firing of the green ceramic.

Once formed, the channels in the green state may be filled with conductor pastes containing particles of Ag, Au, Cu or other conductive metals, using a screen printing process. Metallization pastes, such as copper conductor paste, silver conductor paste, gold, conductor paste, and the like are selected to be compatible with the ceramic tape formulations. The conductor paste filled channels are co-fired with the green ceramic under appropriate conditions, e.g., nitrogen environment for copper, and temperatures ranging from about 600° to about 900° C.

The thick film bus lines 90 may also be formed in green ceramic tape using a hot embossing process. According to the process, fine metal wires having appropriate dimensions are placed on top of the green tape layer and then electric current is forced through the wires by a driving circuit designed to produce constant resistance in the load wires and thereby constant temperature of a level sufficient to allow the ceramic tape material to flow under the heat and applied pressure and the wires to become embedded into the ceramic tape. The wires are then disconnected from the drive circuit and trimmed flush with the edge of the ceramic at each end of the substrate. The wires may function as independent circuit conductors or bus lines 90.

Microchannels and conductor lines may also he formed in a fired ceramic layer. Channels may be formed in a fired ceramic substrate in a number of ways. One method of forming channels in a fired ceramic substrate involves the use of wet HF etching of the substrate through an appropriately patterned metal mask. Other standard approaches for cutting channels in the fired ceramic material include, but are not limited to, laser cutting, dicing, and water jet machining of the substrate. The bus lines 90 may then be screen printed or the ceramic channels filled by using appropriate metal pastes such as described above. For more closely spaced bus lines 90 that are 50 microns wide, photoimageable metal pastes may be used through UV exposure and developing with sodium carbonate or appropriate solvents and then firing at about 850° C. Yet another method for providing the thick film bus lines 90 is through the use of digital printing techniques followed by annealing at a temperature of less than about 400° C.

The thick film bus lines 90 may be formed in microchannels in a glass substrate by the following process. Open channels may he formed in the glass substrate by micromachining techniques involving the use of photosensitive masking materials and etching with HF solutions. After the open channels are formed, the glass substrate containing the open channels may be bonded anodically or by diffusion, to another glass substrate.

Figure 9A:
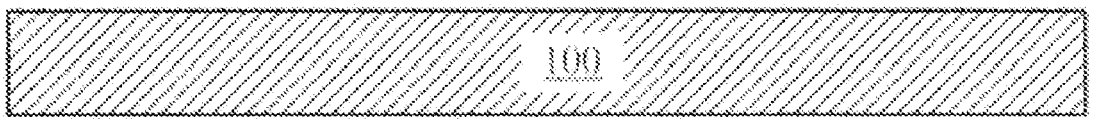
FIGS. 9A-9G is process flow scheme for providing metallization channels in a non-semiconductor substrate according to an embodiment of the disclosure.
Figure 9B:
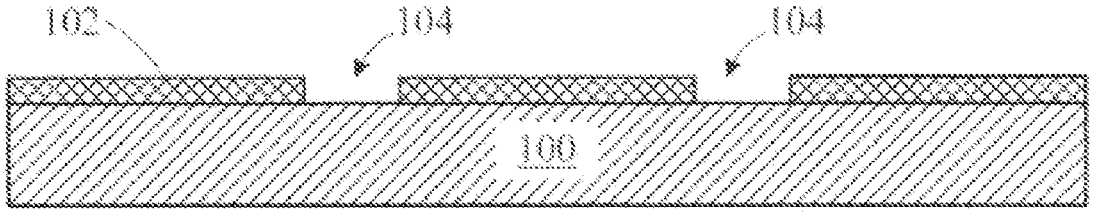
Figure 9C:
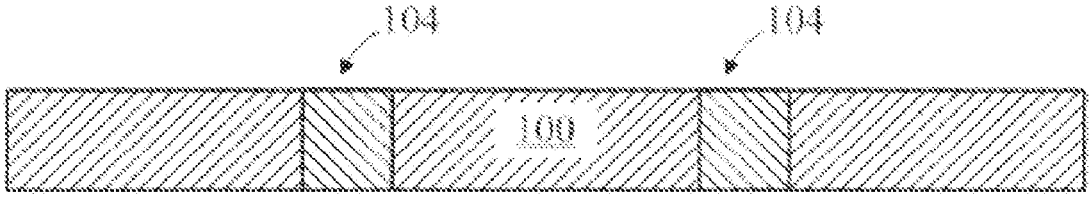
Figure 9D:
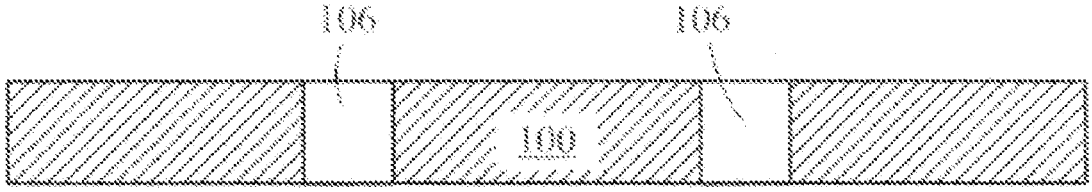

In an alternative process, illustrated in FIGS. 9A-9G, a photosensitive glass substrate 100 may be used. The photosensitive glass substrate 100 may be patterned by exposure to a UV (290-330 nm) radiation source through a mask 102 to provide exposed areas 104 for etching as shown in FIG. 9B. The exposed glass substrate 100 is then heat treated for crystallization of exposed areas 104 as shown in FIG. 9C. The exposed areas 104 may then he preferentially etched with 5-10 wt. % hydrofluoric acid solution to provide etched channels 106 (FIG. 9D). If desired, the glass substrate 100 containing the channels 106 may he ground and polished to provide an improved surface roughness.

Figure 9E:
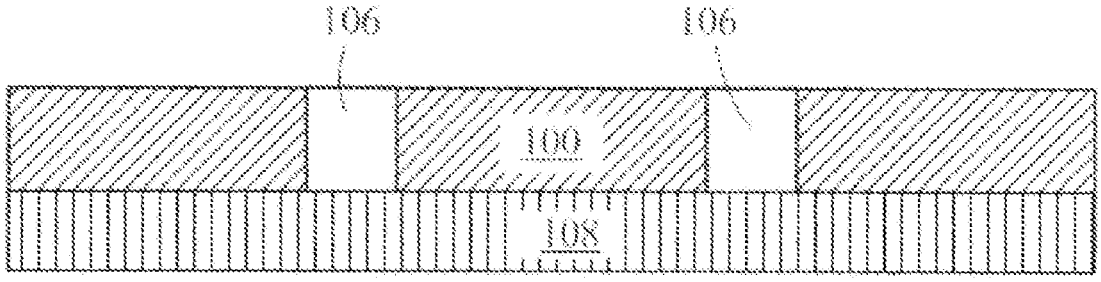

The substrate 100 with the open channels 106 may be bonded to another unpatterned solid glass substrate 108 (or other substrate material) by soldering, diffusion bonding, gluing, and the like to close channels 106 from one side 110 thereof as shown in FIG. 9E.

In another alternative process, channels having the appropriate depth in a single photosensitive glass substrate may be formed by controlling the density of UV radiation energy and/or subsequent etch exposure times. It is possible to control energy density using variable gray scale mask patterns.

Figure 9F:
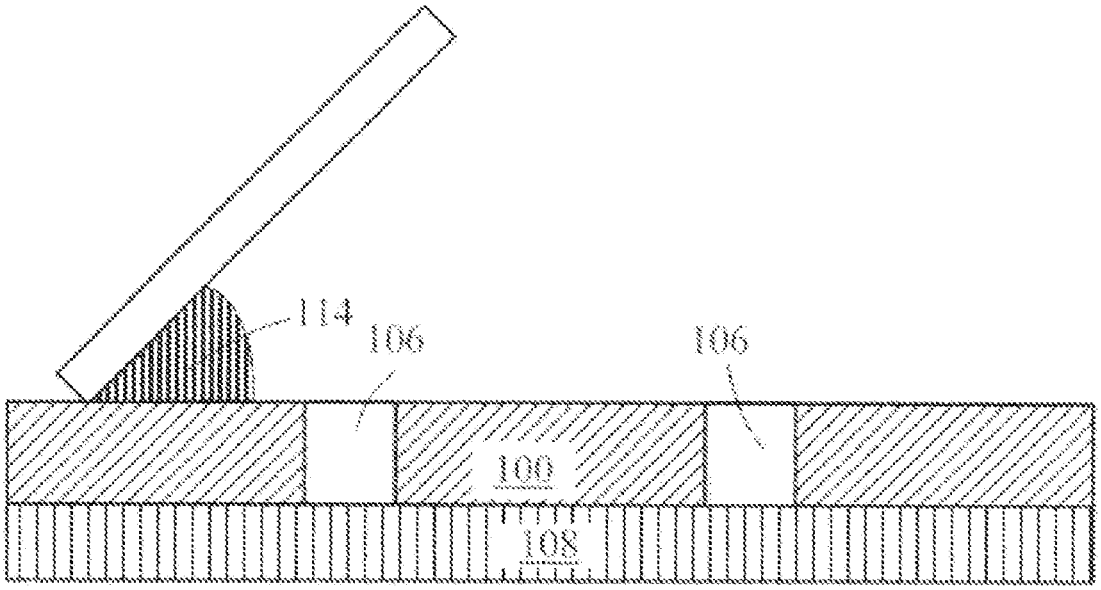
Figure 9G:
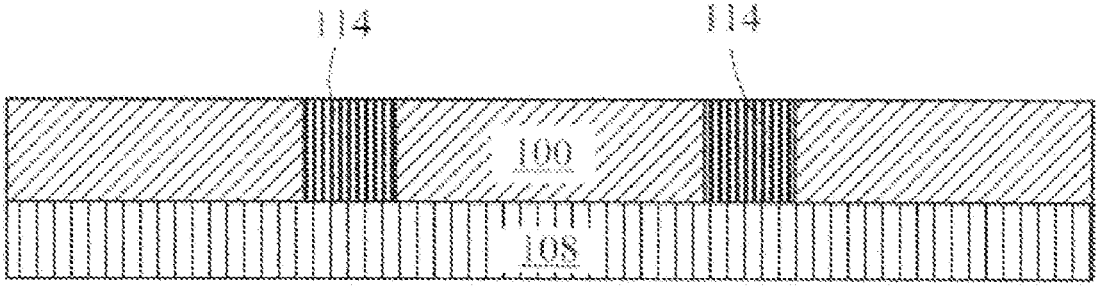

Once formed in the substrate 100, the channels 106 may be tilled with a screen printed metal conductor pastes 112 as shown in FIG. 9F. The substrate 100 is then fired at less than about 450° C. to provide the substrate 100/108 containing thick film bus lines 114. In an alternative to screen printing the conductor pastes 112, digital deposition of metal ink followed by sintering/annealing may also be used to provide the thick film bus lines 114.

If the thick film bus lines cannot be embedded in the substrate before thin film processing to provide the thin film address lines, the thick film bus lines may be applied over the top of the thin film address lines either on glass or ceramic substrates. In this case a dielectric material having vias/openings therein in appropriate locations to make a connection between thin and thick film metallization is applied to the substrate containing the thin film address lines. The challenge with an overprinted thick film is that most thick films require high temperature cure/sinter steps to burn off solvents/polymers. The thin films already patterned on the substrate may not withstand temperatures in excess of 400 to 450° C. Low temperature screen printable metal pastes are commercially available for the flat panel display industry and the photovoltaic cell industry.

At numerous places throughout this specification, reference has been made to a number of U.S. patents and/or patent publications. The relevant portions of all such cited documents are expressly incorporated in full into this disclosure as if fully set forth herein.

The foregoing embodiments are susceptible to considerable variation in their practice. Accordingly, the embodiments are not intended to be limited to the specific exemplifications set forth hereinabove. Rather, the foregoing embodiments are within the spirit and scope of the appended claims, including the equivalents thereof available as a matter of law.

The patentees do not intend to dedicate any disclosed embodiments to the public, and to the extent any disclosed modifications or alterations may not literally fall within the scope of the claims, they are considered to be part hereof under the doctrine of equivalents.

What is claimed is:

1. A micro-fluid ejection head comprising:

N actuators on a first substrate; and logic capable of driving the N actuators on a second substrate different than the first substrate, wherein there are less than N electrical connections between the first and second substrates.

2. The micro-fluid ejection head of claim 1, further comprising N diodes on the first substrate, wherein each of the N diodes is electrically connected in series with a respective corresponding one of the N actuators.

3. The micro-fluid ejection head of claim 2, wherein the diodes are vertically-oriented Schottky diodes.

4. The micro-fluid ejection head of claim 2, wherein the first substrate comprises a material selected from the group consisting of glass, ceramic, and combinations thereof.

5. The micro-fluid ejection head of claim 4, wherein a semiconductor material is formed on the first substrate.

6. The micro-fluid ejection head of claim 5, wherein the semiconductor material is polysilicon.

7. The micro-fluid ejection head of claim 6, wherein the silicon is laser recrystallized on the first substrate to achieve the desired properties.

8. The micro-fluid ejection head of claim 7, wherein the diodes are formed in polysilicon.

9. The micro-fluid ejection head of claim 8, wherein the diodes are Schottky diodes.

10. The micro-fluid ejection head of claim 9, wherein the Schottky diodes are vertically oriented.

11. The micro-fluid ejection head of claim 9, wherein the Schottky diodes are laterally oriented.

12. The micro-fluid ejection head of claim 8, wherein the diodes are P-N junction diodes.

13. The micro-fluid ejection head of claim 1, wherein a plurality of the N actuators are electrically connected to a bus.

14. The micro-fluid ejection head of claim 13, wherein a thickness of the bus is greater than 2 micrometers.

15. The micro-fluid ejection head of claim 14, wherein a thickness of the bus is greater than 6 micrometers.

16. The micro-fluid ejection bend of claim 14, wherein the bus is embedded in the first substrate.

17. The micro-fluid ejection head of claim 16, wherein the first substrate comprises a ceramic substrate having a green tape layer, and wherein the bus is embedded in the green tape layer.

18. The micro-fluid ejection head of claim 14, wherein the bus is formed in a channel of the first substrate.

19. The micro-fluid ejection head of claim 18, wherein the first substrate comprises a ceramic substrate having a green tape layer, and wherein the channel is in the green tape layer.

20. The micro-fluid ejection head of claim 14, wherein the bus is formed by screen printing a metallization material.

* * * * *